US009471018B2

(12) United States Patent
Kawaguchi

(10) Patent No.: US 9,471,018 B2
(45) Date of Patent: Oct. 18, 2016

(54) FIXING DEVICE AND IMAGE FORMING APPARATUS

(71) Applicant: KYOCERA Document Solutions Inc., Osaka (JP)

(72) Inventor: Kotatsu Kawaguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/962,039

(22) Filed: Dec. 8, 2015

(65) Prior Publication Data

US 2016/0179043 A1 Jun. 23, 2016

(30) Foreign Application Priority Data

Dec. 22, 2014 (JP) ..... 2014-259163

(51) Int. Cl.
*G03G 15/20* (2006.01)

(52) U.S. Cl.
CPC ..... *G03G 15/2053* (2013.01); *G03G 15/2017* (2013.01); *G03G 2215/2003* (2013.01); *G03G 2215/2035* (2013.01)

(58) Field of Classification Search
CPC ..... G03G 15/2017; G03G 15/2053; G03G 2215/2003; G03G 2215/2016
See application file for complete search history.

(56) References Cited

U.S. PATENT DOCUMENTS 6,014,539 A * 1/2000 Sano ..... G03G 15/2053 219/216
8,831,496 B2 * 9/2014 Ishida ..... G03G 15/2064 399/329
2005/0185994 A1 * 8/2005 Inada ..... G03G 15/2053 399/328
2006/0182474 A1 * 8/2006 Naito ..... G03G 15/2053 399/329
2011/0135355 A1 * 6/2011 Baba ..... G03G 15/2053 399/329
2013/0195491 A1 * 8/2013 Suzuki ..... G03G 15/2046 399/69
2013/0209146 A1 * 8/2013 Yamaji ..... G03G 15/2053 399/329
2014/0376934 A1 * 12/2014 Egi ..... G03G 15/205 399/33
2014/0376935 A1 * 12/2014 Egi ..... G03G 15/2053 399/33
2015/0071688 A1 * 3/2015 Yamaguchi ..... G03G 15/2053 399/329

FOREIGN PATENT DOCUMENTS

JP 2006-072218 A 3/2006

OTHER PUBLICATIONS

Bal Seal Engineering. "Coefficient of Thermal Expansion for Various Materials at Different Temperatures." Jun. 25, 2004.*

* cited by examiner

*Primary Examiner* — David Gray
*Assistant Examiner* — Carla Therrien
(74) *Attorney, Agent, or Firm* — Studebaker & Brackett PC

(57) ABSTRACT

A fixing device includes a fixing belt, a cap member, a first elastic member, and a second elastic member. The cap member is attached to an end portion of the fixing belt. The first elastic member is mounted in the cap member so as to be opposite to an outer circumferential surface of the fixing belt. The first elastic member is ring-shaped. The second elastic member is mounted in the cap member so as to be opposite to an inner circumferential surface of the fixing belt. The second elastic member is ring-shaped. The first elastic member is in pressed contact with the cap member and with the outer circumferential surface of the fixing belt. The second elastic member is disposed with a space from the inner circumferential surface of the fixing belt and thermally expands toward the inner circumferential surface of the fixing belt.

12 Claims, 5 Drawing Sheets

FIXING DEVICE AND IMAGE FORMING APPARATUS

INCORPORATION BY REFERENCE

The present application claims priority under 35 U.S.C. §119 to Japanese Patent Application No. 2014-259163, filed on Dec. 22, 2014. The contents of this application are incorporated herein by reference in their entirety.

BACKGROUND

The present disclosure relates to a fixing device and an image forming apparatus.

A known fixing device in a generic image forming apparatus employs a belt-nip system. In the fixing device, a fixing belt is pressed against a rotatory member by a pressure member. The fixing belt rotates by sliding on the rotatory member. In order to reduce resistance of the sliding fixing belt to the pressure member, a lubricant is applied onto an inner circumferential surface of the fixing belt. However, the lubricant may leak out at opposite ends of the fixing belt.

A known fixing device restricts the leakage of lubricant. The fixing device includes a low friction member between a pressure member and a fixing belt in order to reduce friction between the pressure member and the fixing belt. An end of the low friction member is stepped in order to restrict the leakage of the lubricant.

SUMMARY

A fixing device according to a first aspect of the present disclosure includes a fixing belt, a cap member, a first elastic member, and a second elastic member. The cap member is attached to an end portion of the fixing belt. The first elastic member is mounted in the cap member so as to be opposite to an outer circumferential surface of the fixing belt. The first elastic member is ring-shaped. The second elastic member is mounted in the cap member so as to be opposite to an inner circumferential surface of the fixing belt. The second elastic member is ring-shaped. The first elastic member is in pressed contact with the cap member and with the outer circumferential surface of the fixing belt. The second elastic member is disposed with a space from the inner circumferential surface of the fixing belt and thermally expands toward the inner circumferential surface of the fixing belt.

An image forming apparatus according to a second aspect of the present disclosure includes an image forming section and the above-described fixing device. The image forming section forms an image on a sheet. The fixing device fixes, to the sheet, the image that has been formed on the sheet.

DETAILED DESCRIPTION

Figure 1A:
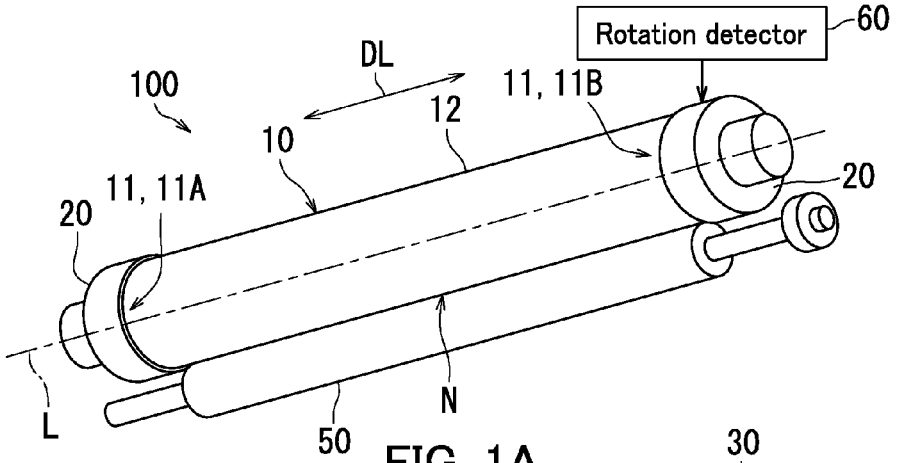
FIG. 1A is a perspective view illustrating a fixing device according to an embodiment of the present disclosure.

Hereinafter, an embodiment of the present disclosure will be described with reference to the accompanying drawings. It should be noted that elements in the drawings that are the same or equivalent are labelled using the same reference signs and description thereof is not repeated.

A fixing device 100 according to an embodiment of the present disclosure will be described with reference to FIGS. 1A to 1C. FIG. 1A is a perspective view illustrating the fixing device 100. The fixing device 100 includes a fixing belt 10, a pair of cap members 20, a pressure roller 50, and a rotation detector 60.

The fixing belt 10 fixes an image on a sheet passing through a fixing nip N between the fixing belt 10 and the pressure roller 50. The fixing belt 10 is rotatable about a rotation axis L of the fixing belt 10. A direction DL parallel to the rotation axis L is referred to as an axial direction DL. The fixing belt 10 is an endless belt having a substantially cylindrical shape and flexibility. The pair of cap members 20 are attached to a pair of end portions 11 of the fixing belt 10, respectively. The pair of end portions 11 are opposite end portions of the fixing belt 10 in the axial direction DL. The rotation detector 60 detects rotation of one of the cap members 20 that is attached to one end portion 11B among the pair of end portions 11 of the fixing belt 10. The pressure roller 50 is in pressed contact with the fixing belt 10 and forms the fixing nip N therebetween.

Figure 1B:
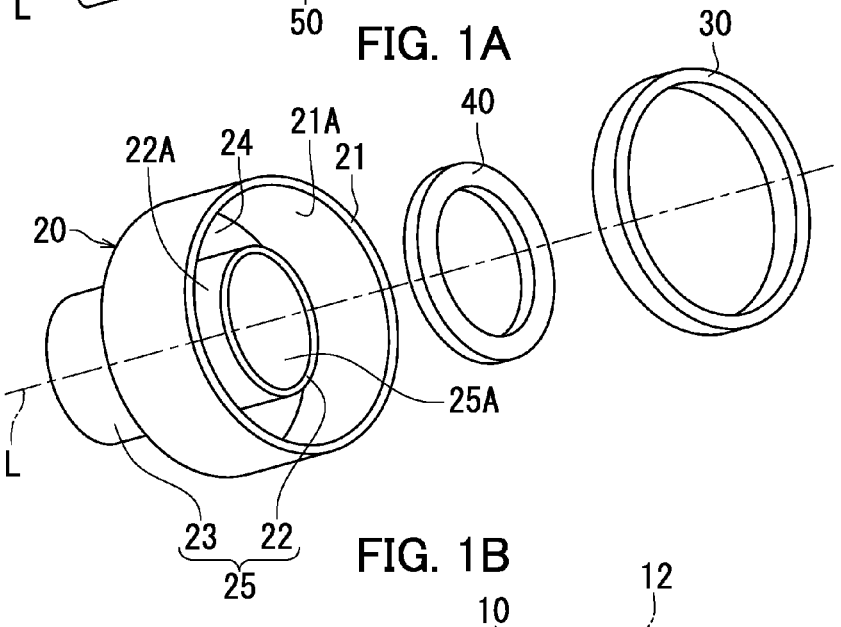
FIG. 1B is an exploded perspective view illustrating a cap member, a first elastic member, and a second elastic member of the fixing device according to the embodiment of the present disclosure.

FIG. 1B is an exploded perspective view illustrating one of the cap members 20, a first elastic member 30, and a second elastic member 40 of the fixing device 100. The cap member 20 illustrated in FIG. 1B is the one attached to an end portion 11A among the pair of end portions 11 of the fixing belt 10. The fixing device 100 further includes the first elastic member 30 and the second elastic member 40. The first elastic member 30 and the second elastic member 40 are each ring-shaped (circular ring in the present embodiment). The inner diameter of the first elastic member 30 is greater than the outer diameter of the second elastic member 40.

Each cap member 20 includes a first cylindrical portion 21, a second cylindrical portion 22, a third cylindrical portion 23, and a base portion 24. The first cylindrical portion 21 and the second cylindrical portion 22 are each cylindrical (hollow circular cylindrical in the present embodiment). The first cylindrical portion 21 and the second cylindrical portion 22 are concentric about the rotation axis L. The inner diameter of the first cylindrical portion 21 is greater than the outer diameter of the second cylindrical portion 22. The second cylindrical portion 22 is therefore located inside of the first cylindrical portion 21. The first cylindrical portion 21 and the second cylindrical portion 22 each extend from the disk-like base portion 24 toward the end portion 11B of the fixing belt 10. The distance (length) from the base portion 24 to a distal end of the first cylindrical portion 21 is longer than the distance (length) from the base portion 24 to a distal end of the second cylindrical portion 22.

The third cylindrical portion 23 is cylindrical (hollow circular cylindrical in the present embodiment) and extends from the base portion 24 further outward than the end portion 11A of the fixing belt 10. The inner diameter and the outer diameter of the third cylindrical portion 23 are equal to the inner diameter and the outer diameter of the second cylindrical portion 22, respectively. The second cylindrical portion 22 and the third cylindrical portion 23 form a cylindrical body 25. The cylindrical body 25 has a hollow interior 25A.

Figure 1C:
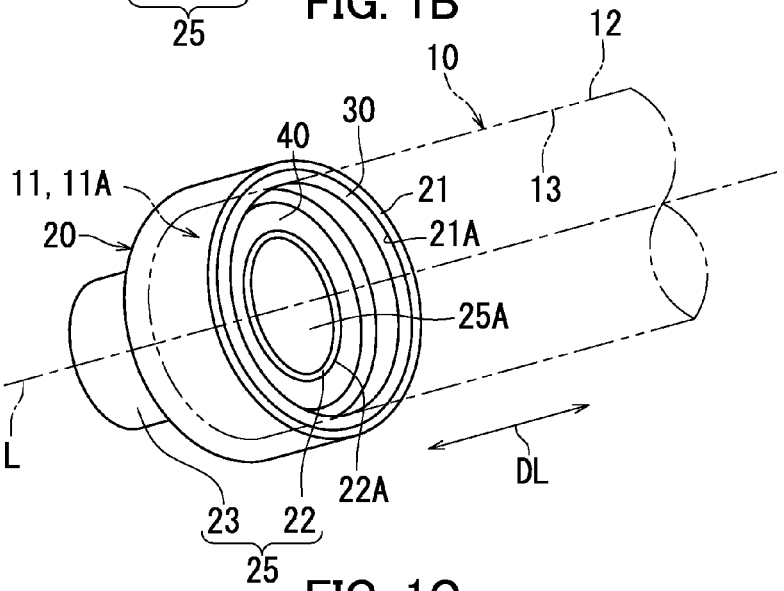
FIG. 1C is a perspective view illustrating the cap member of the fixing device according to the embodiment of the present disclosure with the first elastic member and the second elastic member mounted in the cap member.

FIG. 1C is a perspective view illustrating the cap member 20 of the fixing device 100 with the first elastic member 30 and the second elastic member 40 mounted in the cap member 20. As illustrated in FIGS. 1B and 1C, the first elastic member 30 is attached to an inner circumferential surface 21A of the first cylindrical portion 21. The second elastic member 40 is attached to an outer circumferential surface 22A of the second cylindrical portion 22. The cap member 20, with the first elastic member 30 and the second elastic member 40 mounted therein, is attached to the end portion 11A of the fixing belt 10. In this configuration, the cap member 20 is attached to the fixing belt 10 such that the end portion 11A of the fixing belt 10 is disposed between the first elastic member 30 and the second elastic member 40.

The cap member 20 that is attached to the end portion 11B of the fixing belt 10 has the same structure as the cap member 20 illustrated in FIGS. 1B and 1C, and therefore description thereof will be omitted. The fixing device 100 further includes a first elastic member 30 and a second elastic member 40, not illustrated in the interest of ease of illustration, that are mounted in the cap member 20 of the end portion 11B. The first elastic member 30 and the second elastic member 40 that are not illustrated have the same structures as the first elastic member 30 and the second elastic member 40 that are illustrated in FIGS. 1B and 1C, and description thereof will be omitted.

Figure 2A:
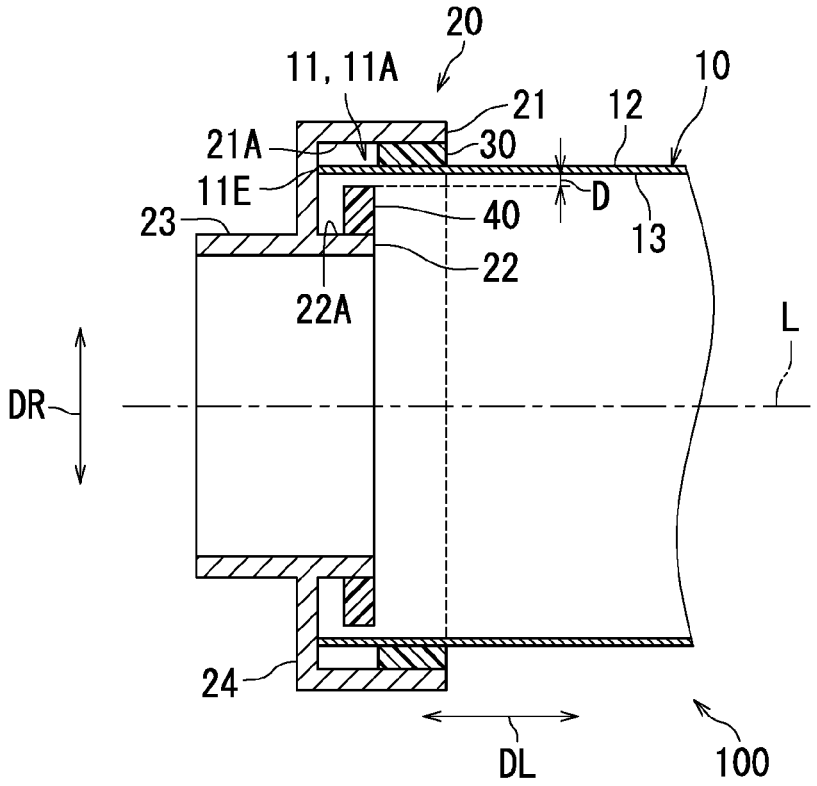
FIGS. 2A and 2B are cross sectional views each illustrating a part of the fixing device according to the embodiment of the present disclosure.

Configuration of the fixing belt 10, the cap member 20, the first elastic member 30, and the second elastic member 40 will be described in detail with reference to FIGS. 2A and 2B. FIG. 2A is a cross sectional view illustrating a part of the fixing device 100 when the second elastic member 40 is not thermally expanded.

The first elastic member 30 is attached to the first cylindrical portion 21 of the cap member 20 so as to be opposite to an outer circumferential surface 12 of the fixing belt 10. The first elastic member 30 is in pressed contact with the inner circumferential surface 21A of the first cylindrical portion 21 and with the outer circumferential surface 12 of the fixing belt 10. The first elastic member 30 for example includes a silicone rubber as a material thereof. Examples of the silicone rubber include a foamed silicone rubber. The first elastic member 30 for example has a rubber hardness (Asker-C hardness) of 20 to 40.

The second elastic member 40 is attached to the second cylindrical portion 22 of the cap member 20 so as to be opposite to the inner circumferential surface 13 of the fixing belt 10. The second elastic member 40 is disposed on the outer circumferential surface 22A of the second cylindrical portion 22 with a space D (for example, 100 μm) from the inner circumferential surface 13 of the fixing belt 10. The second elastic member 40 preferably includes a foamed silicone rubber as a material thereof. Preferably, the second elastic member 40 has a coefficient of linear expansion of at least $1\times10^{-4}$/° C. More preferably, the second elastic member 40 has a coefficient of linear expansion of no less than $1\times10^{-4}$/° C. and no greater than $1\times10^{-3}$/° C. The second elastic member 40 for example has a rubber hardness (Asker-C hardness) of 20 to 40.

Figure 2B:
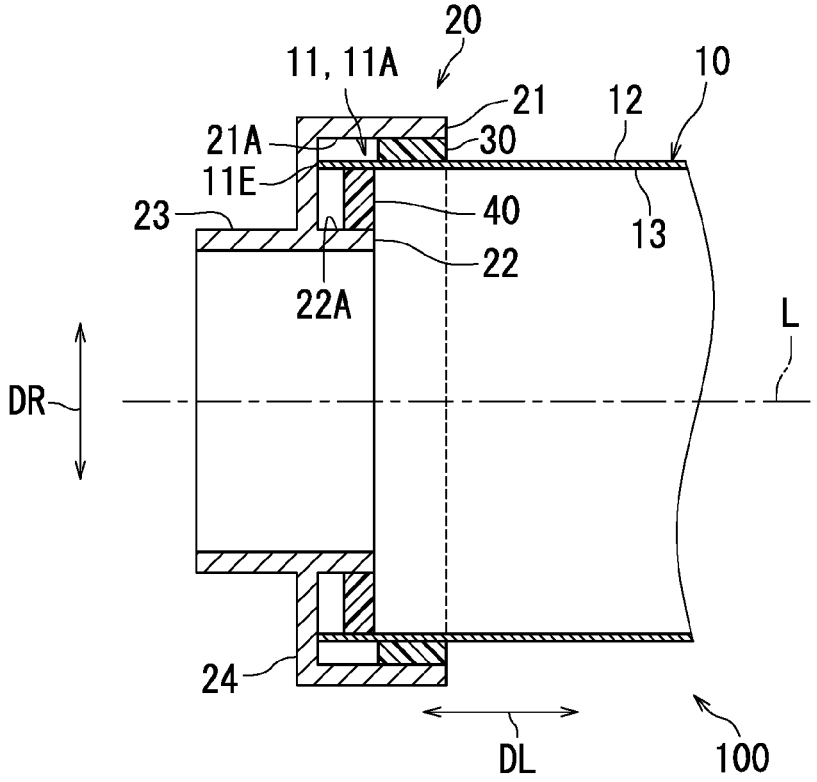

FIG. 2B is a cross sectional view illustrating the part of the fixing device 100 when the second elastic member 40 is thermally expanded. The second elastic member 40 is heated as the fixing belt 10 is heated. Accordingly, the second elastic member 40 thermally expands toward the inner circumferential surface 13 of the fixing belt 10. Consequently, the second elastic member 40 comes in pressed contact with the inner circumferential surface 13 of the fixing belt 10 and with the outer circumferential surface 22A of the second cylindrical portion 22. The outer diameter of the second elastic member 40 at room temperature is smaller than the inner diameter of the end portion 11A of the fixing belt 10 at room temperature (FIG. 2A). The outer diameter of the second elastic member 40 under heating is greater than the inner diameter of the end portion 11A of the fixing belt 10 at room temperature. Under heating, therefore, the end portion 11A of the fixing belt 10 is pressed out by the second elastic member 40 in a radial direction DR of the fixing belt 10. As a result of being pressed out, the end portion 11A of the fixing belt 10 under heating has a slightly greater inner diameter than the end portion 11A of the fixing belt 10 at room temperature.

According to the present embodiment, as described above with reference to FIGS. 2A and 2B, the second elastic member 40 comes in pressed contact with the inner circumferential surface 13 of the fixing belt 10 and with the cap member 20 when thermally expanded. As a result, a lubricant applied onto the inner circumferential surface 13 of the fixing belt 10 can be prevented from leaking out at the end portion 11A of the fixing belt 10 when the fixing belt 10 is heated for fixing an image on a sheet. Since the second elastic member 40 is disposed with the space D from the inner circumferential surface 13 of the fixing belt 10, the cap member 20 can be readily attached to the fixing belt 10 before heating. Under heating, the fixing belt 10 is pressed and held between the first elastic member 30 and the second elastic member 40, and therefore can be prevented from being displaced in the radial direction DR.

Since it is possible to restrict leakage of lubricant according to the present embodiment, the cap member 20 can be prevented from slipping on the outer circumferential surface 12 of the fixing belt 10. Thus, the cap member 20 has substantially the same rotational speed as the fixing belt 10. As a result, the rotation detector 60 can accurately detect the rotational speed of the fixing belt 10 by detecting the rotational speed of the cap member 20.

According to the present embodiment, not only the end portion 11A but also the end portion 11B has a cap member 20 with a first elastic member 30 and a second elastic member 40 mounted therein. Therefore, the leakage of lubricant can be restricted more reliably. Alternatively, only one of the end portion 11A and the end portion 11B may have the cap member 20.

According to the present embodiment, the first cylindrical portion 21 and the second cylindrical portion 22 facilitate mounting of the first elastic member 30 and the second elastic member 40 with a simple configuration. Since the first cylindrical portion 21 has a larger length than the second cylindrical portion 22, the second elastic member 40 can be readily attached to the second cylindrical portion 22.

According to the present embodiment, the first elastic member 30 and the second elastic member 40 are separate from one another. In this configuration, the first elastic member 30 and the second elastic member 40 can be mounted more readily compared to a configuration in which the first elastic member 30 and the second elastic member 40 are integrated.

According to the present embodiment, the second elastic member 40 has a coefficient of linear expansion of at least $1\times10^{-4}$/° C. (for example, no less than $1\times10^{-4}$/° C.), and thus the second elastic member 40 can be efficiently brought in pressed and sealed contact with the inner circumferential surface 13 of the fixing belt 10 upon application of heat. As a result, the leakage of lubricant can be restricted more reliably. Since the second elastic member 40 is formed from a foamed silicone rubber, the second elastic member 40 can easily have a coefficient of linear expansion of no less than $1\times10^{-4}$/° C.

According to the present embodiment, the second elastic member 40 is disposed at a location closer to an edge 11E of the fixing belt 10 than the first elastic member 30. In such a configuration, the second elastic member 40 is shifted in position relative to the first elastic member 30 so as not to be opposite to the first elastic member 30 or so as to be partially opposite to the first elastic member 30. It is therefore possible to prevent the second elastic member 40 from restricting deformation of the end portion 11A (11) of the fixing belt 10 due to pressure applied by the pressure roller 50. As a result, the end portion 11A (11) of the fixing belt 10 can be deformed into a desired shape. Deforming the end portion 11A (11) of the fixing belt 10 into a desired shape allows the fixing belt 10 and the cap member 20 to be in closer contact. The rotation of the cap member 20 therefore keeps pace with the rotation of the fixing belt 10 more accurately. As a result, the rotation detector 60 can detect the rotation of the fixing belt 10 more accurately by detecting the rotation of the cap member 20.

Figure 3:
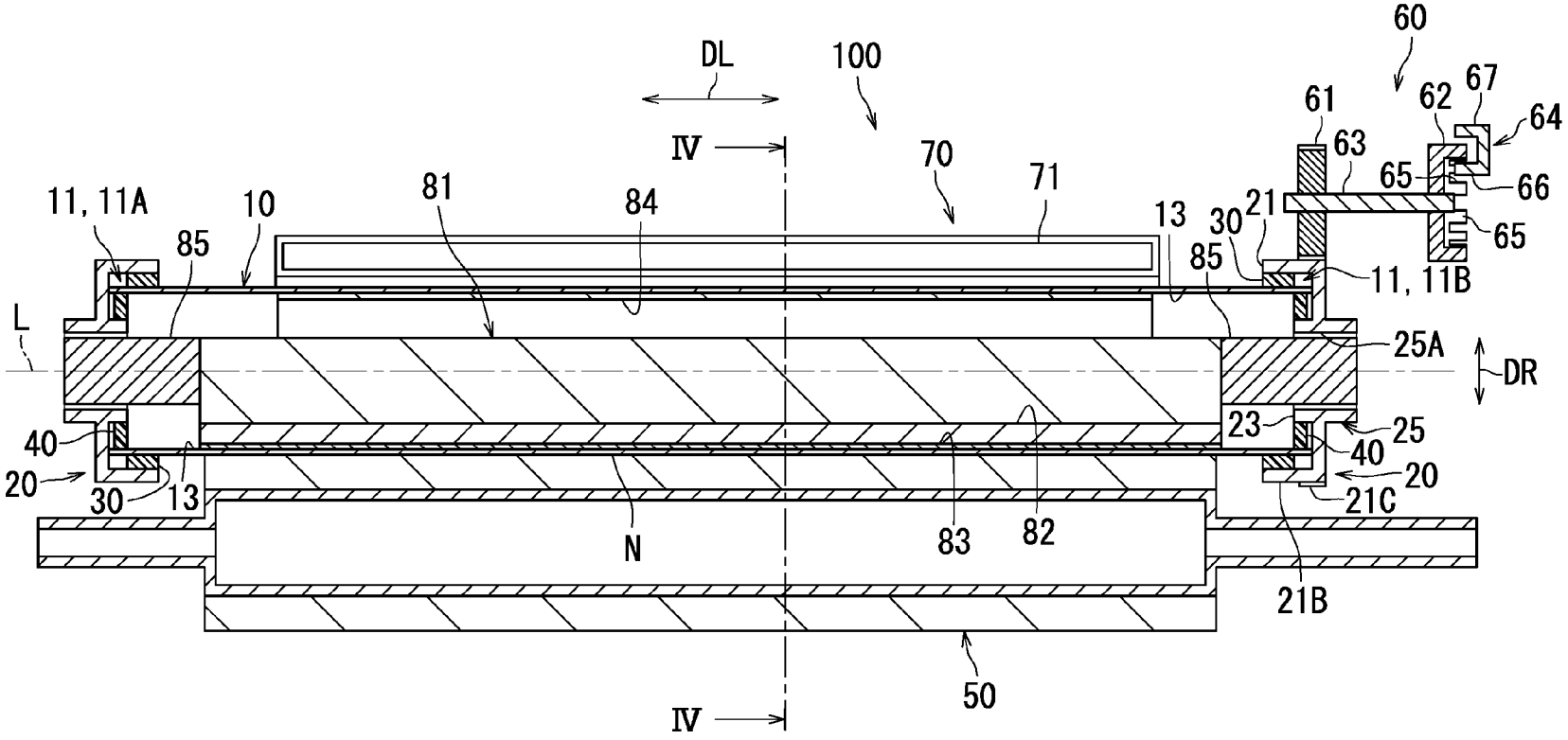
FIG. 3 is a cross sectional view illustrating the fixing device according to the embodiment of the present disclosure.
Figure 4:
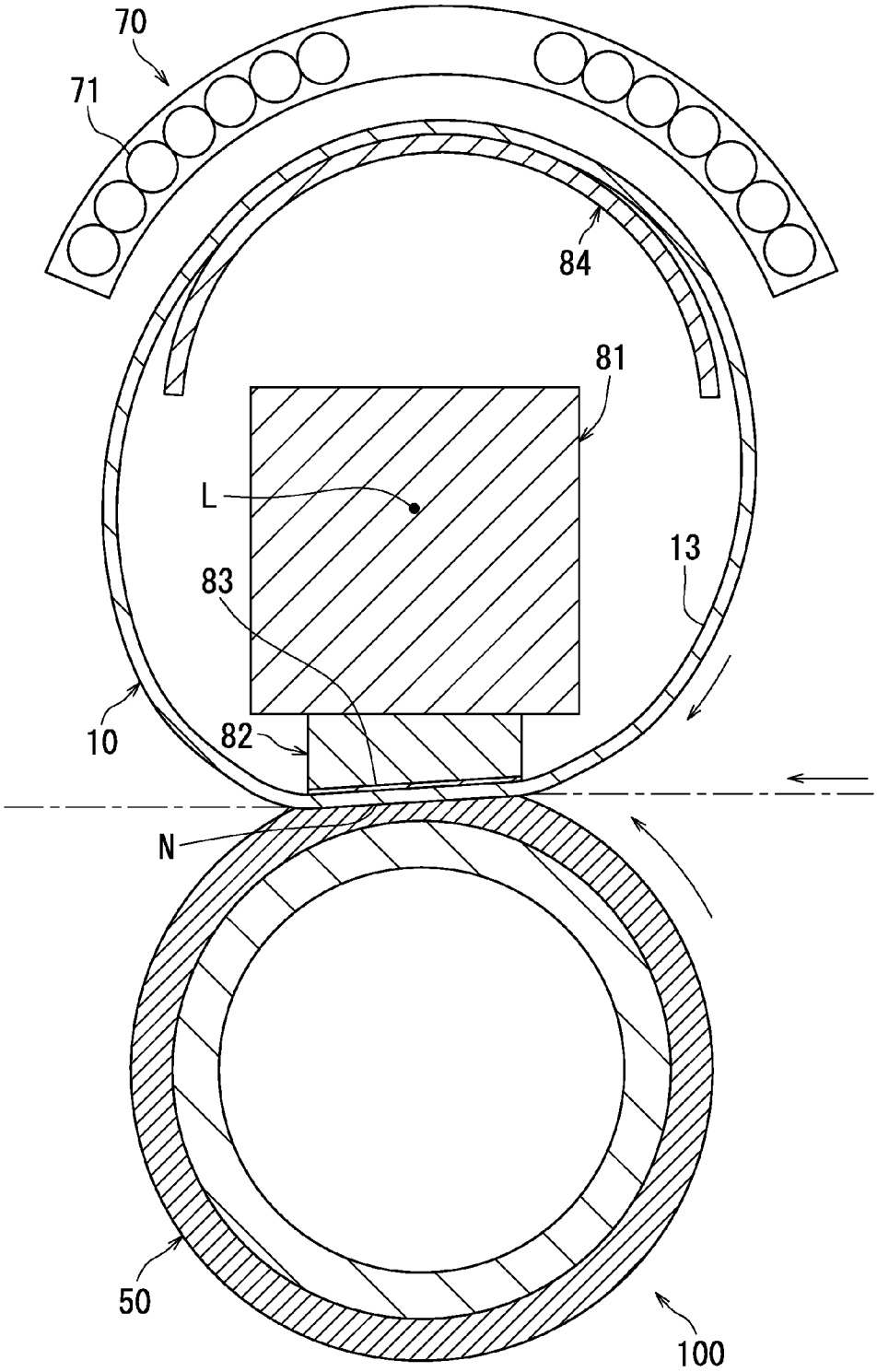
FIG. 4 is a cross sectional view taken along line IV-IV in FIG. 3.

Overall configuration of the fixing device 100 will be described with reference to FIGS. 3 and 4. FIG. 3 is a cross sectional view illustrating the fixing device 100. FIG. 4 is a cross sectional view taken along line IV-IV in FIG. 3.

As illustrated in FIGS. 3 and 4, the fixing device 100 further includes a fixing unit 70 (heating section), a supporting member 81, a pressing member 82, a sheet member 83, a guide member 84, and a pair of shafts 85.

The fixing unit 70 heats the fixing belt 10 and heats the second elastic members 40 via the fixing belt 10. More specifically, the fixing unit 70 includes a coil 71. A magnetic field generated by the coil 71 acts on the fixing belt 10 to generate eddy current therein, and consequently the fixing belt 10 produces heat. The second elastic members 40 are heated and thermally expand with the heat produced by the fixing belt 10. FIG. 3 illustrates the fixing belt 10 and the second elastic members 40 under heating by the fixing unit 70.

The supporting member 81, the pressing member 82, the sheet member 83, and the guide member 84 are all disposed inside of the fixing belt 10. The pair of shafts 85 protrude from opposite ends of the supporting member 81 along the axial direction DL. Each shaft 85 is disposed in the hollow interior 25A (FIG. 1B) of the cylindrical body 25 of the corresponding cap member 20. The pressing member 82 presses the fixing belt 10 toward the pressure roller 50. The sheet member 83 is in contact with the inner circumferential surface 13 of the fixing belt 10. The guide member 84 is supported by the supporting member 81. The guide member 84 is in contact with the inner circumferential surface 13 of the fixing belt 10 and cooperates with the pressing member 82 to stretch the fixing belt 10.

While the fixing belt 10 is rotating, the fixing belt 10 slides on the sheet member 83. A lubricant is applied onto a region of the inner circumferential surface 13 of the fixing belt 10 that is in sliding contact with the sheet member 83. The lubricant for example includes a fluorinated grease or a silicone oil as a material thereof.

As illustrated in FIG. 3, the rotation detector 60 includes a first connecting gear 61, a circular pulse plate 62 disposed opposite to the first connecting gear 61, a connecting shaft 63 that connects the first connecting gear 61 with the pulse plate 62, and a sensor 64 disposed adjacent to the pulse plate 62. The fixing device 100 further includes a second connecting gear 21C disposed on the outer circumferential surface 21B of the first cylindrical portion 21. The first connecting gear 61 is in meshing engagement with the second connecting gear 21C. Light blocking portions 65 are stood along a circumference of the pulse plate 62. The sensor 64 is for example a photo interrupter (PI) and has a light emitting member 66 and a light receiving member 67.

While the cap members 20 are rotating in accompaniment with the rotation of the fixing belt 10, the second connecting gear 21C rotates, and the first connecting gear 61 in meshing engagement with the second connecting gear 21C rotates. The rotation of the first connecting gear 61 is transmitted to the pulse plate 62 via the connecting shaft 63, and thus the pulse plate 62 rotates. While the pulse plate 62 is rotating, light emitted from the light emitting member 66 of the sensor 64 toward the light receiving member 67 of the sensor 64 is intermittently blocked by the light blocking portions 65 of the pulse plate 62. Thus, the light receiving member 67 of the sensor 64 outputs a pulse signal. The frequency of the pulse signal is proportional to the rotational speed of the pulse plate 62. The rotational speed of the pulse plate 62 is proportional to the rotational speed of the cap member 20, and therefore the rotation detector 60 detects the rotational speed of the cap member 20, that is, the rotational speed of the fixing belt 10 via the pulse plate 62.

According to the present embodiment, as described above with reference to FIGS. 3 and 4, the second elastic members 40 thermally expand upon application of heat by the fixing unit 70 to be in pressed contact with the inner circumferential surface 13 of the fixing belt 10 and with the respective cap members 20. Thus, the second elastic members 40 can be readily caused to thermally expand using the fixing unit 70. While the fixing unit 70 is not heating the fixing belt 10, the second elastic members 40 do not thermally expand and are spaced away from the inner circumferential surface 13 of the fixing belt 10. The second elastic members 40 and the inner circumferential surface 13 of the fixing belt 10 therefore have the space D (FIG. 2A) therebetween while the fixing unit 70 is not heating the fixing belt 10 (for example, during production, maintenance, power-off, or sleep). As a result, the cap members 20 can be readily attached to the fixing belt 10.

Figure 5:
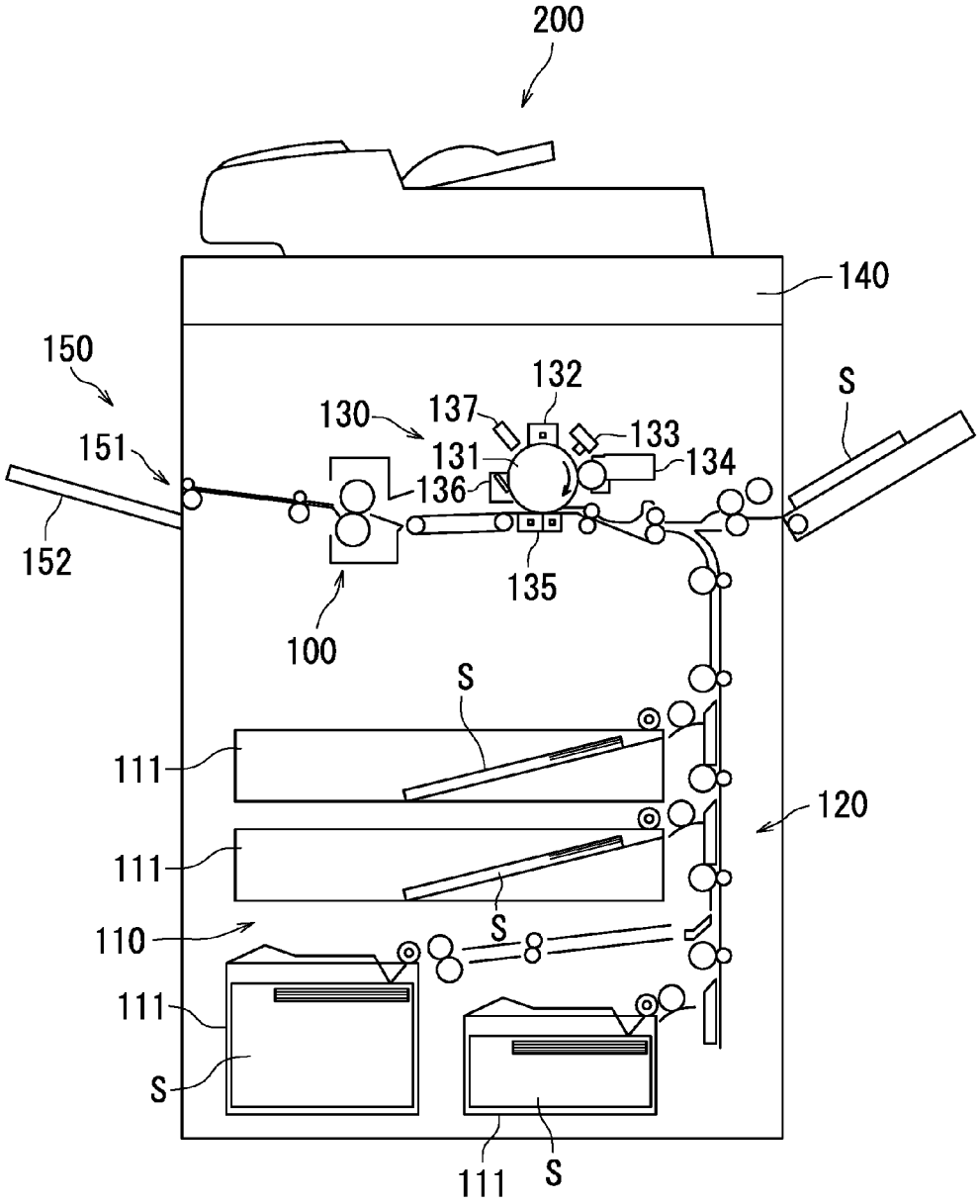
FIG. 5 is a diagram illustrating an image forming apparatus according to the embodiment of the present disclosure.

An example of an image forming apparatus 200 including the fixing device 100 will be described with reference to FIG. 5. FIG. 5 is a diagram illustrating the image forming apparatus 200. The image forming apparatus 200 includes the fixing device 100, a sheet feed section 110, a sheet conveyance section 120, an image forming section 130, an image reading section 140, and an ejecting section 150.

The image reading section 140 reads an image of an original document. The sheet feed section 110 includes a plurality of cassettes 111 that each contain sheets S and feeds the sheets S in each cassette 111 to the sheet conveyance section 120 one sheet at a time.

The sheet conveyance section 120 conveys the sheet S toward the image forming section 130. The image forming section 130 forms a toner image (image) on the sheet S by an electrophotographic process. More specifically, the image forming section 130 includes a rotatably supported photosensitive drum 131. The image forming section 130 further includes a charger 132, a light exposure section 133, a development section 134, a transfer section 135, a cleaning section 136, and a static eliminating section 137 around the photosensitive drum 131. The charger 132 and the light exposure section 133 form an electrostatic latent image on the photosensitive drum 131. The development section 134 develops the electrostatic latent image into a toner image. The transfer section 135 transfers the toner image onto the sheet S. After the transfer of the toner image, the cleaning section 136 cleans residual toner on the photosensitive drum 131, and the static eliminating section 137 eliminates static electricity on the photosensitive drum 131.

The sheet having the toner image transferred thereon is conveyed toward the fixing device 100. The fixing device 100 applies heat and pressure onto the sheet S to fix, to the sheet S, the toner image that has been transferred onto the sheet S. The sheet having the toner image fixed thereto is then ejected onto an exit tray 152 by a pair of ejection rollers 151 of the ejecting section 150.

An embodiment of the present disclosure has been described with reference to the drawings (FIGS. 1A to 5) so far. However, the present disclosure is not limited to the above embodiment and may be practiced in various forms without deviating from the essence thereof (for example, as explained below in sections (1) and (2)). Elements of configuration disclosed in the above embodiment can be combined as appropriate in various different forms. For example, some of the elements of configuration in the embodiment may be omitted. Furthermore, elements of configuration in different embodiments may be combined as appropriate. The drawings schematically illustrate elements of configuration in order to facilitate understanding. Properties of the elements of configuration illustrated in the drawings such as thickness, length, quantity, and spacing may differ from reality in order to aid preparation of the drawings. Furthermore, properties of elements of configuration described in the above embodiment, such as material properties, shapes, and dimensions, are merely examples and are not intended as specific limitations. Various alterations may be made so long as there is no substantial deviation from the effects of the present disclosure.

(1) Although the fixing device 100 described with reference to FIGS. 3 and 4 includes the fixing unit 70 as a heating section, the heating section is not limited to the fixing unit 70. For example, a halogen heater or a ceramic heater may be used as the heating section.

(2) Although the first elastic members 30 and the second elastic members 40 illustrated in FIGS. 1B to 3 have a rectangular cross-section, the present disclosure is not limited to this shape. For example, the first elastic members 30 and the second elastic members 40 may have a circular cross-section or an ellipsoidal cross-section. The shape of the first elastic members 30 and the second elastic members 40 may be selected in accordance with the design of the fixing device 100.

What is claimed is:

1. A fixing device comprising:

a fixing belt;

a cap member that is attached to an end portion of the fixing belt;

a first elastic member that is mounted in the cap member so as to be opposite to an outer circumferential surface of the fixing belt, the first elastic member being ring-shaped; and a second elastic member that is mounted in the cap member so as to be opposite to an inner circumferential surface of the fixing belt, the second elastic member being ring-shaped, wherein the first elastic member is in pressed contact with the cap member and with the outer circumferential surface of the fixing belt, the second elastic member is disposed with a space from the inner circumferential surface of the fixing belt and thermally expands toward the inner circumferential surface of the fixing belt, and the first elastic member and the second elastic member are separate from one another.

2. The fixing device according to claim 1, further comprising a heat section that heats the fixing belt, wherein the second elastic member thermally expands upon application of heat by the heating section to come in pressed contact with the inner circumferential surface of the fixing belt and with the cap member.

3. The fixing device according to claim 1, wherein the second elastic member is disposed closer to an edge of the end portion of the fixing belt than the first elastic member.

4. The fixing device according to claim 1, wherein the second elastic member includes a foamed silicone rubber as a material thereof.

5. The fixing device according to claim 1, wherein the second elastic member has a coefficient of linear expansion of at least $1\times10^{-4}/°$ C.

6. The fixing device according to claim 1, further comprising a rotation detector that detects rotation of the cap member.

7. The fixing device according to claim 1, wherein the second elastic member is disposed so as not to be opposite to the first elastic member.

8. The fixing device according to claim 1, wherein the second elastic member is disposed so as to be partially opposite to the first elastic member.

9. An image forming apparatus comprising:

an image forming section that forms an image on a sheet; and the fixing device according to claim 1, wherein the fixing device fixes, to the sheet, the image that has been formed on the sheet.

10. A fixing device comprising:

a fixing belt;

a cap member that is attached to an end portion of the fixing belt;

a first elastic member that is mounted in the cap member so as to be opposite to an outer circumferential surface of the fixing belt, the first elastic member being ring-shaped; and a second elastic member that is mounted in the cap member so as to be opposite to an inner circumferential surface of the fixing belt, the second elastic member being ring-shaped, wherein the first elastic member is in pressed contact with the cap member and with the outer circumferential surface of the fixing belt, the second elastic member is disposed with a space from the inner circumferential surface of the fixing belt and thermally expands toward the inner circumferential surface of the fixing belt, the cap member includes a first cylindrical portion and a second cylindrical portion that are concentric about a rotation axis of the fixing belt, the second cylindrical portion is located inside of the first cylindrical portion, the first elastic member is in pressed contact with an inner circumferential surface of the first cylindrical portion and with the outer circumferential surface of the fixing belt, and the second elastic member is disposed on an outer circumferential surface of the second cylindrical portion with a space from the inner circumferential surface of the fixing belt and thermally expands toward the inner circumferential surface of the fixing belt.

11. The fixing device according to claim 10, wherein the first cylindrical portion has a larger length than the second cylindrical portion.

12. An image forming apparatus comprising:

an image forming section that forms an image on a sheet; and the fixing device according to claim 10, wherein the fixing device fixes, to the sheet, the image that has been formed on the sheet.

* * * * *